US008525767B2

(12) United States Patent
Yin

(10) Patent No.: US 8,525,767 B2
(45) Date of Patent: Sep. 3, 2013

(54) METHOD AND DEVICE FOR AUTOMATICALLY COMPENSATING COMMON ELECTRODE VOLTAGE

(75) Inventor: Xinshe Yin, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 1228 days.

(21) Appl. No.: 12/128,657

(22) Filed: May 29, 2008

(65) Prior Publication Data

US 2009/0066627 A1 Mar. 12, 2009

(30) Foreign Application Priority Data

Sep. 7, 2007 (CN) ..... 2007 1 0121528

(51) Int. Cl.
*G09G 3/36* (2006.01)

(52) U.S. Cl.
USPC ..... 345/94; 345/87; 345/88; 345/89; 345/90; 345/91; 345/92; 345/93; 345/95; 345/96; 345/97; 345/98; 345/99; 345/100; 345/101; 345/102; 345/103; 345/104; 345/204; 345/208; 345/209; 345/211; 345/212; 345/213; 349/19; 349/33

(58) Field of Classification Search
USPC ..... 345/87–104, 204, 208–213; 349/19, 349/33
See application file for complete search history.

(56) References Cited

U.S. PATENT DOCUMENTS 5,734,361 A * 3/1998 Suzuki et al. ..... 345/74.1
6,532,050 B1 3/2003 Kim et al.
7,768,490 B2 * 8/2010 Huang et al. ..... 345/96

(Continued)

FOREIGN PATENT DOCUMENTS

CN 1290922 4/2001
CN 1912723 2/2007

(Continued)

OTHER PUBLICATIONS

English abstract of CN 1912723 dated Feb. 14, 2007.

(Continued)

*Primary Examiner* — Alexander S Beck
*Assistant Examiner* — Amen Bogale
(74) *Attorney, Agent, or Firm* — Ladas & Parry LLP

(57) ABSTRACT

The present invention directs to a method for automatically compensating a common electrode voltage, comprising: calculating an average shift amount of a common electrode voltage according to gray scale data in a line on a displayed image, processing the average shift amount of the common electrode voltage to be a digital signal then converting it into an analog signal then into an average shift amount voltage waveform, and superposing it with a common electrode voltage waveform to form a new output signal waveform for driving the common electrode; the present invention also directs to a device for automatically compensating a common electrode voltage, comprising a data input module, a looking up module, a data operation module, a data encoding and converting module, a waveform generator and an operational amplification module. In the method and device for automatically compensating the common electrode voltage according to the present invention, a common electrode is driven at same time when a pixel electrode in one line on a liquid crystal display screen is driven, charges on the common electrode are compensated, such that common electrode voltage delay is avoided and image quality displayed by the liquid crystal display screen is improved dramatically.

16 Claims, 4 Drawing Sheets

(56) References Cited

U.S. PATENT DOCUMENTS

| | | | | |
|---|---|---|---|---|
| 2003/0020851 | A1 | 1/2003 | Kim et al. | |
| 2006/0152462 | A1 * | 7/2006 | Furihata et al. | 345/98 |
| 2008/0001903 | A1 * | 1/2008 | Chung et al. | 345/100 |

FOREIGN PATENT DOCUMENTS

| | | | |
|---|---|---|---|
| JP | 11-288255 | A | 10/1999 |
| JP | 2006-178074 | A | 7/2006 |
| JP | 2006-195152 | A | 7/2006 |
| JP | 2007-33514 | A | 2/2007 |
| KR | 1999-011728 | | 2/1999 |

OTHER PUBLICATIONS

English abstract of CN 1290922 dated Apr. 11, 2001.

English abstract of KR 1999-11728 dated Feb. 18, 1999.

* cited by examiner

METHOD AND DEVICE FOR AUTOMATICALLY COMPENSATING COMMON ELECTRODE VOLTAGE

TECHNICAL FIELD

The present invention directs to a method and device for automatically compensating a common electrode voltage, in particular, to a method and device for automatically compensating a common electrode voltage on a liquid crystal display device.

BACKGROUND ART

A liquid crystal display usually uses progressive scanning to drive a liquid crystal display screen. FIG. 1 is a schematic diagram for pixel electrode driving of a thin film transistor liquid crystal display screen. As shown in FIG. 1, each pixel on a liquid crystal display can be equivalent to a liquid crystal capacitor ($C_{LC}$) and a storage capacitor (Cstg), one terminal of a pixel electrode is connected to a drain of a thin film transistor (TFT), a source of the TFT is connected to data lines (Sn, Sn+1) of the display screen, a gate of the TFT is connected to gate lines (Gn, Gn+1) of the display, and the other terminal of the pixel electrode is connected to a common electrode (Vcom) of the liquid crystal display screen.

Currently, a driving method of a pixel electrode of a liquid crystal display device is to charge the pixel electrode, and the charge amount being charged on each pixel electrode depends on respective gray scale of each pixel; and a common electrode uses a constant voltage driving method, that is, a common electrode voltage is a fixed voltage value regardless what graphical image the liquid crystal display outputs, and what charge amount is on a pixel electrode. FIG. 2 is a structure diagram of the driving device of a common electrode of prior art. As shown by FIG. 2, the common electrode driving circuit comprises resistors R1 and R2 and an adjustable resistor R3. A high voltage provided by power supply (AVDD) is divided by R1, R2 and R3, and then processed by an operational amplifier to obtain a common electrode voltage Vcom, and the common electrode voltage drives the common electrode of liquid crystal display.

For the prior art using a fixed common electrode voltage to drive a liquid crystal display, there are problems as follow: when a pixel electrode is driven by a driving circuit, it is impossible to keep total charge amount of positive charges and negative charges on the pixel electrode as zero, and there may be more positive charges or negative charges on the pixel electrode for some specific graphical images. Since the charge amount on the common electrode is equal to that on the pixel electrode, a larger common electrode current is needed to make compensation when the charge amount on the pixel electrode has severe unbalanced situation, however, since common electrode wires in the common electrode driving circuit have some impedance which delays the common electrode voltage's arrival at the pixel electrode, the voltage on the pixel electrode is not the target voltage at this moment, thus image quality displayed during this stage is deteriorated dramatically.

DISCLOSURE OF INVENTION

An objective of the present invention is to provide a method and device for automatically compensating a common electrode voltage, which resolves the technical shortage in the prior art that quality of the display image is shifted due to the delay of a common electrode voltage.

In order to accomplish the above objective, the present invention provides a method for automatically compensating a common electrode voltage, comprising:

step 1, calculating average shift amount of a common electrode voltage according to gray scale data of pixels in a line on a displayed image;

step 2, digitally encoding said average shift amount and converting it into an analog signal;

step 3, converting said analog signal into a voltage waveform;

step 4, superposing said voltage waveform with the common electrode voltage waveform to form a new output signal waveform for driving the common electrode.

In the technical solution above, said step 1 comprises:

step 11, inputting the gray scale data of the pixels in the one line on the displayed image;

step 12, calculating a voltage value, which is corresponding to each pixel gray scale data and is output to a display screen by a source driver, to form an lookup table, and said lookup table comprises positive source driver output voltage values and negative source driver output voltage values corresponding to each pixel gray scale data, respectively;

step 13, calculating the average shift amount of the common electrode voltage according said gray scale data and said lookup table.

In the above technical solution, said step 13 comprises:

step 131, making j=1 and ΔV=0, where j is a serial number of present pixel point in the one line on the image, and ΔV is total shift amount of the common electrode voltage;

step 132, receiving gray scale data of the j-th pixel point and a polarity control signal of the source driver;

step 133, judging driving polarity of the source driver according to said serial number of the j-th pixel point and said polarity control signal of the source driver, and if it is positive polarity driving, then performing step 134, or if it is negative polarity driving, then performing step 135;

step 134, from the lookup table, looking up a positive polarity source driver output voltage value corresponding to the gray scale data of the j-th pixel point, calculating ΔVj=Vcom−PV, wherein Vcom is the common electrode voltage value, PV is the positive polarity source driver output voltage value corresponding to the gray scale data of the j-th pixel point, and ΔVj is shift amount of the common electrode voltage of the j-th pixel point;

step 135, from the lookup table, looking up a negative polarity source driver output voltage value corresponding to the gray scale data of the j-th pixel point, calculating ΔVj=Vcom−NV, wherein Vcom is the common electrode voltage value, NV is the negative polarity source driver output voltage value corresponding to the gray scale data of the j-th pixel point, and ΔVj is shift amount of the common electrode voltage of the j-th pixel point;

step 136, judging whether j is equal to n, if so, performing step 138, otherwise performing step 137, wherein n is total number of pixel points in the one line on the displayed image;

step 137, making j=j+1, performing step 132;

step 138, calculating $$\Delta V = \sum_{j=1}^{n} \Delta V_j,$$

wherein ΔVj is shift amount of the common electrode voltage of the j-th pixel point, n is total number of pixel points in the one line on the displayed image, and ΔV is total shift amount of the common electrode voltage;

step 139, calculating ΔVcom=ΔV/n, wherein ΔV is total shift amount of the common electrode voltage, n is total number of pixel points in the one line on the displayed image, and ΔVcom is average shift amount of the common electrode voltage.

In the above technical solution, converting said analog signal into a voltage waveform in said step 3 is that said analog signal is converted into a rectangular voltage waveform, a triangular voltage waveform, a pre-charged triangular voltage waveform or an index voltage waveform, and integration of the waveform is equal to the average shift amount of said common electrode voltage.

In the above technical solution, said step 4 is superposing said voltage waveform with the common electrode voltage waveform in order to form said new output signal waveform having waveform integration equal to sum of the common electrode voltage value and the average shift amount of the common electrode voltage.

With the above technical solution, the average shift amount of the common electrode voltage can be calculated according to the gray scale data of the one line on the displayed image, and the common electrode is driven after the common electrode voltage has been compensated, such that the common electrode voltage can be compensated automatically.

In order to realize the objective, the present invention further provides a device for automatically compensating a common electrode voltage comprising:

a data input module for inputting gray scale data of all pixel points in a line on a displayed image;

a looking up module for calculating a voltage value outputted to a display screen by a source driver corresponding to each gray scale data so as to form a lookup table;

a signal module for inputting a source driver polarity control signal and a common electrode voltage waveform;

a data operation module connected with said data input module, said looking up module and said signal module and for calculating the average shift amount of the common electrode voltage according to the gray scale data of the pixel in the one line on the displayed image;

a data encoding and converting module connected with the data operation module and for digitalizing said average shift amount into a digital signal, and converting said digital signal into an analog signal;

a waveform generator connected with said data encoding and converting module and for converting said analog signal into a voltage waveform;

an operational amplification module connected with said waveform generator and said signal module and for superposing said voltage waveform with said common electrode voltage waveform to form a new output signal waveform for driving the common electrode.

In the above technical solution, said data operation module comprises:

a receiving sub module connected with said data input module and said signal module and for receiving data;

a judging sub module connected with said looking up module and said receiving sub module and for performing operation judgment and outputting an instruction;

a operating sub module connected with said judging sub module and for operating according to said instruction;

a storage sub module connected with said judging sub module and said operating sub module and for storing data;

an output sub module connected with said operating sub module and said data encoding and converting module and for outputting the average shift amount of the common electrode.

With the above technical solution, automatically compensating the common electrode voltage can be realized, and when the pixel electrode in the one line on the liquid display screen is driven by the driving circuit, the common electrode is driven, charges on the common electrode are compensated, such that the delay of common electrode voltage is avoided, thereby quality of images displayed on the liquid crystal display screen is improved notably.

The technical solution of the present invention will be described in more details hereafter in connection with the accompanying figures and embodiments.

BEST MODE TO CARRY OUT THE INVENTION

Figure 1:
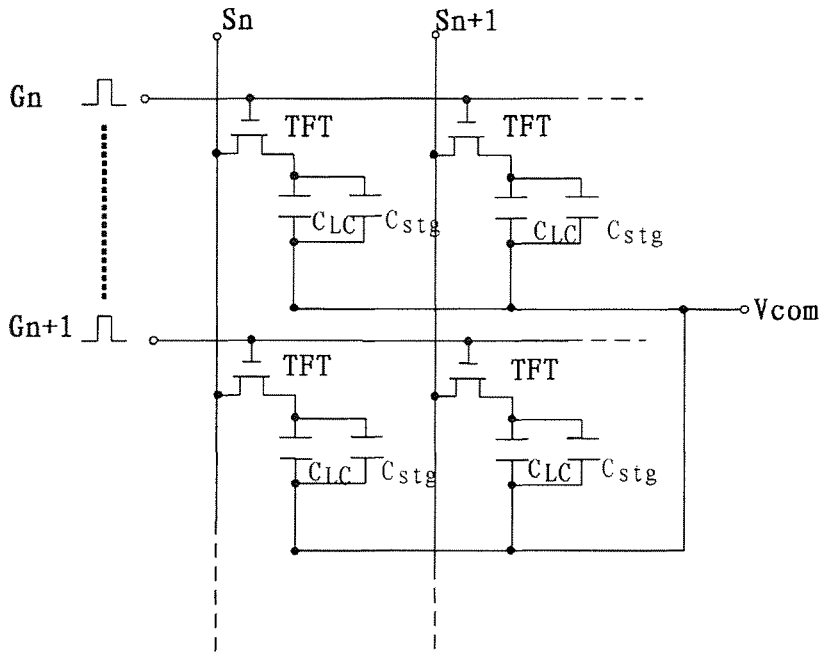
FIG. 1 is a diagram of pixel electrode driving of a thin film transistor liquid crystal display screen.
Figure 2:
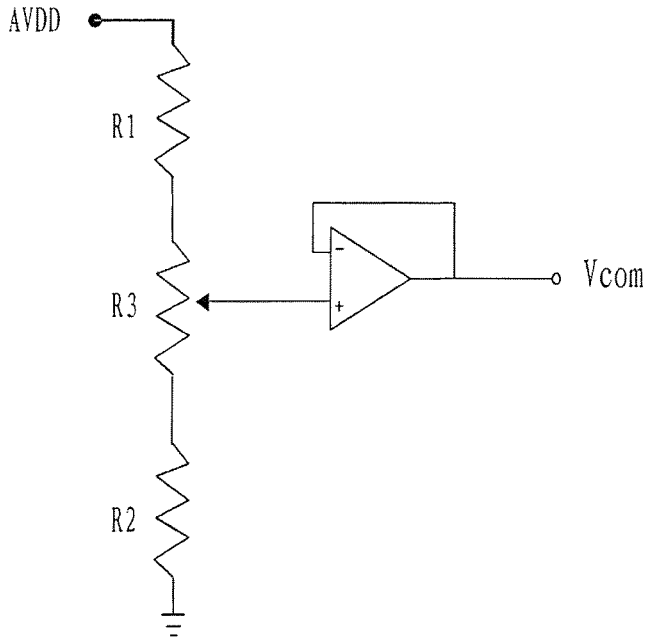
FIG. 2 is a structure diagram of a driving device of a common electrode of the prior art.
Figure 3:
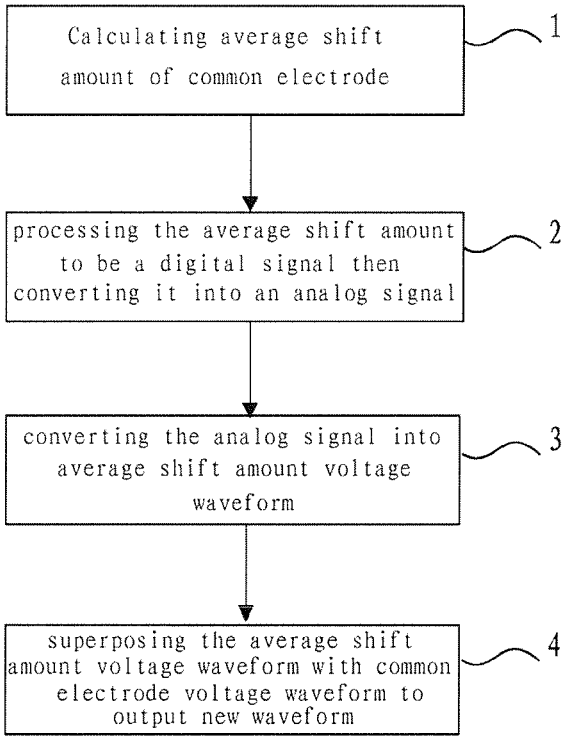
FIG. 3 is a flowchart of a method for automatically compensating a common electrode voltage according to the present invention.

FIG. 3 is a flowchart of a method for automatically compensating a common electrode voltage according to the present invention. As shown in FIG. 3, the method for automatically compensating the common electrode voltage according to the present invention comprises following steps:

step 1, calculating average shift amount of the common electrode voltage according to gray scale data of pixels in a line on a displayed image;

step 2, digitally encoding the average shift amount to a 8-bit or 12-bit digital signal, then converting the 8-bit or 12-bit digital signal into an analog signal;

step 3, converting the analog signal into an average shift amount voltage waveform;

step 4, superposing the average shift amount voltage waveform with the common electrode voltage waveform to form a new output signal waveform for driving the common electrode.

Figure 4:
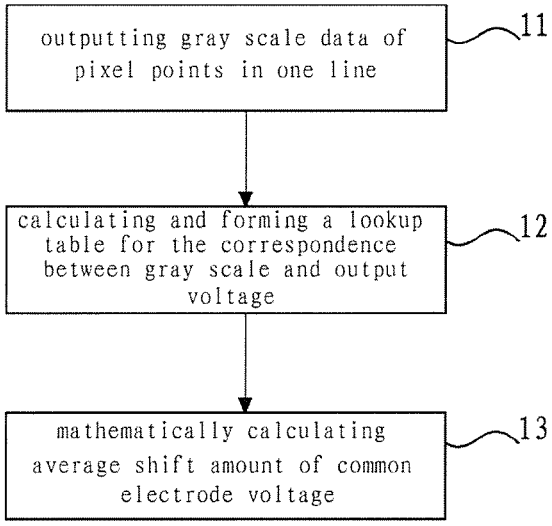
FIG. 4 is a flowchart of an embodiment for calculating average shift amount of the common electrode voltage according to the present invention.

FIG. 4 is a flowchart of an embodiment for calculating average shift amount of the common electrode voltage according to the present invention. As shown in FIG. 4, the step 1 comprises:

step 11, inputting gray scale data of the pixels in the one line on the displayed image;

step 12, calculating a voltage value, which is corresponding to each pixel gray scale and is output to a display screen by a source driver, to form an lookup table, and said lookup table comprises positive polarity source driver output voltage values and negative polarity source driver output voltage values corresponding to each pixel gray scale, respectively;

step 13, calculating the average shift amount of the common electrode voltage corresponding to the gray scale data according the gray scale data and the lookup table.

Figure 5:
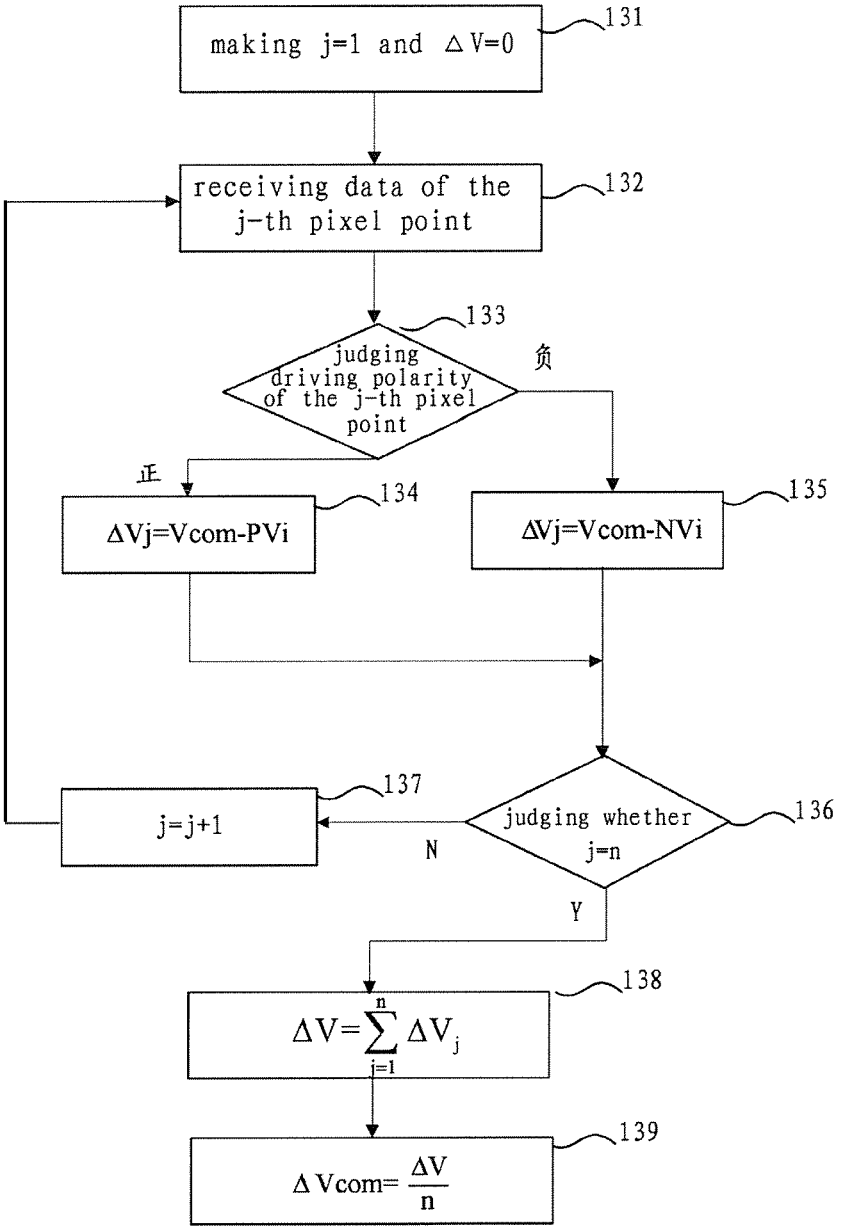
FIG. 5 is a flowchart of another embodiment for calculating average shift amount of the common electrode voltage according to the present invention.

FIG. 5 is a flowchart of another embodiment for calculating the average shift amount of the common electrode voltage according to the present invention. In FIG. 5, j denotes a serial number of a present pixel point in a line on a displayed image; n denotes total number of pixel points in the one line on the displayed image; one pixel point corresponds to one common electrode; i denotes gray scale data of the present pixel point in the one line on the displayed image, gray scale of different pixel points in the one line on the displayed image may be different, i can be any integer between 1 and 256 according to one line on the actually displayed image; PVi denotes a corresponding positive polarity source driver output voltage value when gray scale data of the j-th pixel point is i; NVi denotes a corresponding negative polarity source driver output voltage value when gray scale data of the j-th pixel point is i; Vcom denotes a common electrode DC voltage value; ΔVj denotes common electrode voltage shift amount of the j-th pixel point and its value is equal to difference between the common electrode voltage value and the source driver output voltage value of the j-th pixel point (PVi or NVi); ΔV denotes total shift amount of the common electrode voltage.

As shown in FIG. 5, the step 13 comprises:

step 131, making j=1 and ΔV=0, that is, beginning, from the first pixel point in the one line on the displayed image, to receive gray scale data for all pixels in the one line on the displayed image point by point, the total shift amount of the common electrode voltage ΔV has an initial value equal to 0;

step 132, receiving gray scale data i of the j-th pixel point and a polarity control signal of the source driver;

step 133, judging driving polarity of the source driver according to the serial number j of the j-th pixel point and the polarity control signal of the source driver, and if it is positive polarity driving, then performing step 134, or if it is negative polarity driving, then performing step 135;

step 134, from the lookup table, looking up a corresponding positive polarity source driver output voltage value PVi when the gray scale data of the j-th pixel point is i, calculating a difference value ΔVj between the common electrode voltage value Vcom and the PVi (ΔVj=Vcom−PVi), performing step 136;

step 135, from the lookup table, looking up a corresponding negative polarity source driver output voltage value NVi when the gray scale data of the j-th pixel point is i, calculating a difference value ΔVj between the common electrode voltage value Vcom and the NVi (ΔVj=Vcom−NVi);

step 136, judging whether the serial number j of the j-th pixel point is equal to n being the total number of pixel points of said one line on the displayed image (whether j is equal to n), if so, performing step 138, otherwise performing step 137;

step 137, increasing the serial number j of the j-th pixel by 1 (j=j+1), performing step 132;

step 138, calculating $$\Delta V = \sum_{j=1}^{n} \Delta V_j,$$

wherein ΔVj is the shift amount of the common electrode voltage of the j-th pixel point, ΔV is the total shift amount of the common electrode voltage;

step 139, calculating ΔVcom=ΔV/n, wherein ΔV is the total shift amount of the common electrode voltage, n is the total number of pixel points in the one line on the displayed image, and ΔVcom is average shift amount of the common electrode voltage.

The principle of the method for automatically compensating the common electrode voltage according to the present invention is:

assuming there are totally n pixel points, n pixel electrodes and n common electrodes in a line on a displayed image, a voltage on each pixel electrode is Uj (1≦j≦n), a voltage on each common electrode is Vj (1≦j≦n), gray scale of each pixel point is i, i is any integer between 1 and 256, and different pixel points may have different gray scales.

1. A voltage value outputted to a liquid crystal display screen by a source driver under each gray scale is calculated according to the internal resistance of the source driver and a result of gamma tuning, and a lookup table is formed according to correspondence relationship between them.

Table 1 is a lookup table for the correspondence of the gray scales and the output voltages. As shown in table 1, the lookup table comprises positive polarity source driver output voltages PVi and negative polarity source driver output voltages NVi corresponding to gray scale of each pixel electrode, wherein i denotes different gray scale (i is any integer between 1 and 256).

TABLE 1 as lookup table for the correspondence of gray scales and output voltages

| Gray scale | Output voltage when driven by positive polarity | Output voltage when driven by negative polarity |
|---|---|---|
| 1 | PV1 | NV1 |
| 2 | PV2 | NV2 |
| . . . | . . . | . . . |
| i | PVi | NVi |
| . . . | . . . | . . . |
| 256 | PV256 | NV256 |

2. Polarity used by the source driver to drive the display screen is controlled based on a polarity (POL) signal of the source driver, and differences between the voltage on each pixel electrode PVi or NVi and the common electrode voltage are calculated, respectively.

Table 2 is about driving polarity of each pixel and voltage difference on the pixel electrode when the source driver polarity control signal is high level (+).

TABLE 2

| as driving polarity of pixel and voltage difference on pixel electrode (POL signal is high level) | | | | | | |
|---|---|---|---|---|---|---|
| Item | the first pixel | the second pixel | . . . | the j-th pixel | . . . | The n-th pixel |
| driving polarity | positive | negative | . . . | positive/negative | . . . | positive/negative |
| Voltage difference on pixel electrode | PVi − Vcom | NVi − Vcom | . . . | PVi − Vcom/ NVi − Vcom | | PVi − Vcom/ NVi − Vcom |

As shown in table 2, when the source driver uses positive polarity to drive the first pixel electrode, the voltage difference on the first pixel electrode is PVi−Vcom; when the source driver uses negative polarity to drive the second pixel electrode, the voltage difference on the second pixel electrode is NVi−Vcom; and so on, i.e. when the voltage difference on the j-th pixel electrode is PVi−Vcom or NVi−Vcom.

Further, when the polarity control signal of the source driver is high level (+), the source driver may use negative polarity to drive the first pixel electrode, and the voltage difference on the first pixel electrode is NVi−Vcom; the source driver uses positive polarity to drive the second pixel electrode, and the voltage difference on the second pixel electrode is PVi−Vcom; and so on.

Table 3 is about driving polarity of each pixel and voltage difference on the pixel electrode when the polarity control signal is low level (−).

TABLE 3

| as driving polarity and voltage differences on pixel electrode (POL signal is low level). | | | | | | |
|---|---|---|---|---|---|---|
| Item | the first pixel | the second pixel | . . . . . | the j-th pixel point | . . . . . | the n-th pixel |
| driving polarity | negative | positive | . . . . . | positive/negative | . . . . . | positive/negative |
| Voltage difference on pixel electrode | NVi − Vcom | PVi − Vcom | . . . . . | PVi − Vcom/ NVi − Vcom | | PVi − Vcom/ NVi − Vcom |

As shown in table 3, when the source driver uses positive polarity to drive the first pixel electrode, the voltage difference on the first pixel electrode is NVi−Vcom; when the source driver uses positive polarity to drive the second pixel electrode as well, the voltage difference on the second pixel electrode is PVi−Vcom; and so on.

Further, when the polarity control signal of the source driver is low level (−), the source driver may also use negative polarity to drive the first pixel electrode, and the voltage difference on the first pixel electrode is PVi−Vcom; when the source driver uses negative polarity to drive the second pixel electrode, the voltage difference on the second pixel electrode is NVi−Vcom; and so on.

3. Total charge amount of the pixel electrodes in the one line is calculated by following equation:

$$Q_{pixel\text{-}total} = \sum_{j=1}^{n} (C_{LC} + C_{stg}) \times (U_j - V_{COM})$$

Wherein, $C_{LC}$ and $C_{stg}$ denote a liquid crystal capacity and a storage capacity; $U_j$ denotes an electrode voltage value of the j-th pixel, $U_j - V_{COM}$ denotes difference between the source driver output voltage on the j-th pixel and the common electrode voltage Vcom; if the j-th pixel electrode is driven by positive polarity, when the gray scale is i, $U_j$=PVi; in contrast, if the j-th pixel electrode is driven by negative polarity, when the gray scale is i, $U_j$=NVi.

The meaning of the above equation is that sum of product of voltage difference on two ends of all pixels in the one line and pixel capacity is the total charge amount $Q_{pixle\text{-}total}$ of the pixel electrodes in that line.

4. The shift amount ΔVcom of the common electrode voltage is calculated as follow:

since a corresponding relationship between total charge amount $Q_{Vcom}$ of the common electrode and total charge amount $Q_{pixle\text{-}total}$ of the pixel electrode is $Q_{Vcom} = -Q_{pixle\text{-}total}$ and $V_j = -U_j$, average shift amount of the common electrode voltage is:

$$\begin{aligned} \Delta V_{COM} &= \frac{Q_{Vcom}}{n \times (C_{LC} + C_{stg})} \\ &= -\frac{Q_{pixle\text{-}total}}{n \times (C_{LC} + C_{stg})} \\ &= -\frac{1}{n} \sum_{j=1}^{n} (U_j - V_{COM}) \end{aligned}$$

-continued $$= \frac{1}{n}\sum_{j=1}^{n}(V_{COM} - V_j)$$

Wherein, $\Delta V_{COM}$ denotes the average shift amount of the common electrode voltage; $C_{LC}$ and $C_{stg}$ denote the pixel capacity and the storage capacity; $Q_{Vcom}$ and $Q_{pixle\text{-}total}$ denote the total charge amount of the common electrode and the total charge amount of the pixel electrode respectively, n denotes the total number of pixel electrodes in the one line on the displayed image; $U_j$ denotes the voltage of the j-th pixel electrode; $V_j$ denotes the voltage of the j-th pixel electrode; and $V_{COM}$ denotes the voltage of the common electrode.

5. The resultant voltage $CV_{COM}$ of the common electrode after being compensated has following relationship:

$$CV_{COM}=V_{COM}+\Delta V_{COM}$$

Wherein, $\Delta V_{COM}$ denotes the average shift amount of the common electrode voltage; and $V_{COM}$ denotes the common electrode voltage value.

Therefore, the resultant value of the common electrode voltage after being compensated can be obtained by adding operation.

In the step 4 of the method for automatically compensating the common electrode voltage according to the present invention, converting the analog signal into the average shift amount voltage waveform can be converting the analog signal into a rectangular voltage waveform, a triangular voltage waveform, a pre-charged triangular voltage waveform or an index voltage waveform, wherein integration of the waveform is equal to the average shift amount of the common electrode voltage.

Figure 6:
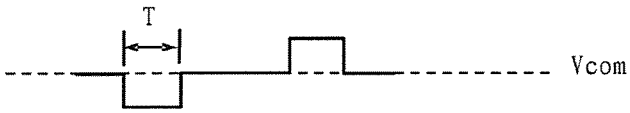
FIG. 6 is a diagram showing the average shift amount of the common electrode voltage is converted into a rectangular voltage waveform.

FIG. 6 is a diagram showing an average shift amount of a common electrode voltage is converted into a rectangular voltage waveform. As shown by FIG. 6, the average shift amount of the common electrode voltage is distributed evenly during charging time of one line.

Figure 7:
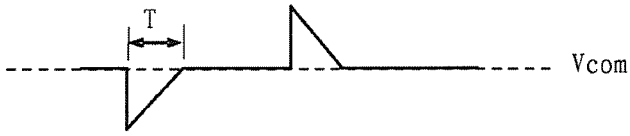
FIG. 7 is a diagram showing the average shift amount of the common electrode voltage is converted into a triangular voltage waveform.

FIG. 7 is a diagram showing an average shift amount of a common electrode voltage is converted into a triangular voltage waveform. Generally, a higher voltage needs to be given when just beginning to charge a pixel electrode, then the voltage value decrease little by little. As shown in FIG. 7, taking the triangular waveform as the driving waveform can make an initial voltage value of the triangular waveform twice of that of the rectangular waveform.

Figure 8:
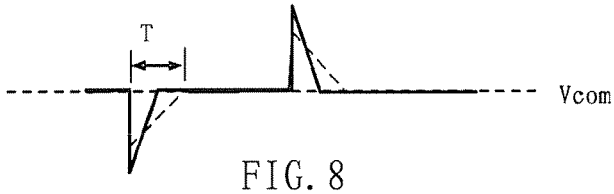
FIG. 8 is a diagram showing the average shift amount of the common electrode voltage is converted into a pre-charged triangular voltage waveform.

FIG. 8 is a diagram showing an average shift amount of a common electrode voltage is converted into a pre-charged triangular voltage waveform. If an initial charging voltage of a triangular waveform is not enough yet and the initial charging voltage needs to be increased further, the pre-charged rectangular waveform can be used. As shown in FIG. 8, based no the triangular waveform, the pre-charged rectangular waveform is designed to pre-charge the common electrode within a charging time less than one line.

Figure 9:
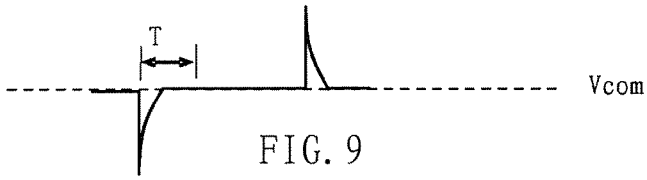
FIG. 9 is a diagram showing the average shift amount of the common electrode voltage is converted into a pre-charged index voltage waveform.

FIG. 9 is a diagram showing an average shift amount of a common electrode voltage is converted into a pre-charged index voltage waveform. As shown in FIG. 9, taking the index waveform as the driving waveform, it is possible to, within a shorter time, pre-charge the common electrode at first.

The "T" in FIG. 6 to FIG. 9 denotes a charging time of common electrodes in one line, Vcom denotes a common electrode voltage. Wherein, the charging time of the common electrodes in the one line is equal to a charging time of pixel electrodes in the one line.

In the step 5 of the method for automatically compensating the common electrode voltage according to the present invention, an average shift amount voltage waveform is superposed with a common electrode voltage waveform to generate a new output signal waveform, integration of the output signal waveform is equal to sum of the common electrode voltage value and the average shift amount of the common electrode voltage.

In order to obtain better quality for a displayed image, a common electrode according to the present invention can be driven by a DC voltage, however, those skilled in the art should understand an AC or other approach can be used to drive the common electrode based on real requirements.

In the method for automatically compensating the common electrode voltage according to the present invention, an average shift amount of the common electrode voltage can be calculated according to gray scale data of a line on a displayed image, and the common electrode can be driven after the common electrode voltage is compensated, thereby the common electrode voltage can be compensated automatically.

Figure 10:
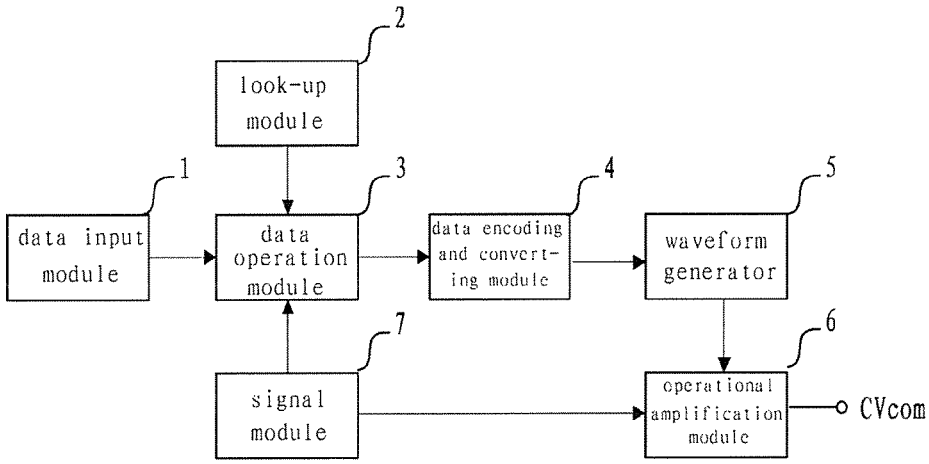
FIG. 10 is a structure diagram of a device for automatically compensating the common electrode voltage according to the present invention.

FIG. 10 is a structure diagram of a device for automatically compensating the common electrode voltage according to the present invention. As shown in FIG. 10, the device for automatically compensating the common electrode voltage according to the present invention has a data input module 1, a looking up module 2, a data operation module 3, a data encoding and converting module 4, a waveform generator 5, an operational amplification module 6 and a signal module 7; the data input module 1, the looking up module 2, the signal module 7 and the data encoding and converting module 4 are connected with the data operation module 3, respectively, the waveform generator 5 and the operational amplification module 6 are connected in turn after the data encoding and converting module 4, and the operational amplification module 6 is connected with the signal module 7.

The data input module 1 is for inputting gray scale data of all pixel points in all pixel electrodes in one line; the looking up module 2 is for calculating a voltage value outputted to a display screen by a source driver corresponding to each gray scale data so as to form a lookup table, the generated lookup table comprises positive polarity source driver output voltage values and negative polarity source driver output voltage values corresponding to each gray scale data; the signal module 7 is for inputting a source driver polarity control signal and a common electrode voltage waveform; the data operation module 3 connected with the data input module 1, the looking up module 2 and the signal module 7, and for calculating an average shift amount of an common electrode voltage; the data encoding and converting module 4 is for processing the average shift amount of an common electrode voltage into a 8-bit or 12-bit digital signal, and converting the 8-bit or 12-bit digital signal intro an analog signal; the waveform generator 5 is for converting the analog signal into an average shift amount voltage waveform; the operational amplification module 6 is for superposing the voltage waveform presenting the average shift amount of the common electrode voltage with the common electrode voltage waveform to form a new output signal waveform for driving the common electrode (CVcom).

The data operation module 3 can comprise: a receiving sub module connected with the data input module and the signal module is for receiving the pixel gray scale data and a source driver control polarity signal; a judging sub module connected with the looking up module and the receiving sub module for performing operation judgment and outputting an instruction; a operating sub module connected with the judging sub module for calculating according to the instruction outputted by the judging sub module; a storage sub module connected with the judging sub module and the operating sub module, for storing data; and an output sub module connected with the operating sub module and the data encoding and converting module, for outputting the average shift amount of the common electrode.

By making reference to FIG. 3 to FIG. 5 and FIG. 10, a working procedure of the device for automatically compensating the common electrode voltage according to the present invention is following:

The data input module 1 begins to input gray scale data i (i can be any integer between 1 and 256) of respective pixels in a line on a displayed image, and the looking up module 2 calculates a voltage value outputted to a displaying screen by a source driver corresponding to each gray scale data i, to form a lookup table, the lookup table comprises positive polarity source driver output voltage values and negative polarity source driver output voltage values corresponding to each pixel gray scale data;

The data operation module 3 performs following: resetting the storage sub module to 0; the receiving sub module is connected with the data input module 1 and the signal module 7, and to receive a first pixel point gray scale data i of the one line on the displayed image and a polarity control signal of a source driver and transmit the data to the judging sub module; the judging sub module judges driving polarity of the source driver according to a serial number of the present pixel point and the polarity signal of the source driver, and if it is positive polarity driving, the judging sub module looks up from the lookup table a positive polarity source driver output voltage PVi corresponding to the time when the gray scale data of the present pixel point is i, and transmits it to the operating sub module which calculates difference ΔVj between the common electrode voltage Vcom and PVi (ΔVj=Vcom−PVi); if it is negative polarity driving, the judging sub module looks up from the lookup table a negative polarity source driver output voltage NVi corresponding to the time when the gray scale data of the present pixel point is i, the operating sub module calculates difference ΔVj between the common electrode voltage Vcom and NVi (ΔVj=Vcom−NVi); the operating sub module calculates sum of difference ΔV between the source driver output voltage and the common electrode voltage and ΔVj (ΔV=ΔV+ΔVj), and updates the storage sub module by the data representing the sum (ΔV=ΔV+ΔVj); the judging sub module judges whether the present pixel point is the last pixel point in the one line on the displayed image (whether j is equal to n, with n being the total number of pixel points in the one line on the displayed image), if not so, the judging sub module sends an instruction to the receiving sub module which begins to receive gray scale data of next pixel point; if so, the storage sub module outputs the latest updated data to the operating sub module which calculates an average value as to all pixel points (n pixel points in total) in the one line (ΔVcom=ΔV/n), the average value is equal to an average shift amount of the common electrode voltage ΔVcom; the operating sub module transmits the average shift amount data of the common electrode voltage to the data encoding and converting module 4 via the output sub module;

The data representing the average shift amount of the common electrode voltage obtained by data calculation may be very large thus needs to be processed further. The data encoding and converting module 4 converts the data representing the average shift amount of the common electrode voltage into a 8-bit or 12-bit digital signal, and convert the 8-bit or 12-bit digital signal into an analog signal which is transmitted to the waveform generator 5, the waveform generator 5 converts it into an average shift amount voltage waveform and outputs it to the operational amplification module 6;

The operational amplification module 6 receives the average shift amount voltage waveform outputted by the waveform generator 5 and the common electrode voltage waveform outputted by the signal module, and superposes the average shift amount voltage waveform with the common electrode voltage to generate a new output signal waveform for driving the common electrode which has a waveform integration equal to sum of the common electrode voltage value and the average shift amount of the common electrode voltage.

In the device for automatically compensating the common electrode voltage according to the present invention, the waveform generator 5 can be a waveform generator which converts an analog signal into a rectangular voltage waveform, a waveform generator which converts an analog signal into a triangular voltage waveform, a waveform generator which converts an analog signal into a pre-charged triangular voltage waveform or a waveform generator which converts an analog signal into a index voltage waveform.

Making reference to FIG. 6, the waveform generator evenly distributes a shift amount of a common electrode with charging time of one line, thereby converting an analog signal into a rectangular voltage waveform.

Making reference to FIG. 7, generally, a bigger voltage needs to be given when just beginning to charge a pixel electrode, then the voltage value decreases little by little. The waveform generator converts an analog signal into a triangular voltage waveform and uses the triangular voltage waveform as a driving waveform, such that the initial voltage value can be twice of that of the rectangular waveform.

If the initial charging voltage of the triangular waveform is not enough yet, and the initial charging voltage needs to be increased further, then a pre-charged triangular waveform can be used. Making reference to FIG. 8, the waveform generator converts an analog signal into a pre-charged triangular voltage waveform and uses the pre-charged triangular waveform to drive the common electrode such that it is possible to pre-charge the common electrode within a charging time less than one line.

Making reference to FIG. 9, the waveform generator converts an analog signal into an index voltage waveform and uses the index waveform to drive the common electrode, such that it is possible to charge the common electrode with a shorter time.

The "T" in FIG. 6 to FIG. 9 denotes the charging time for common electrodes in one line, Vcom denotes the common electrode voltage. Wherein, the charging time for the common electrodes in one line is equal to a charging time for pixel electrodes in the one line.

In the device for automatically compensating the common electrode voltage according to the present invention, when a pixel electrode in one line on a liquid crystal display screen is driven by a driving circuit, a common electrode is driven simultaneously, charges on the common electrode are compensated, such that the delay of the common electrode voltage is avoided, thus the image quality of the liquid crystal display screen is improved dramatically.

At last, it should be understood that the above embodiment is used to explain the technical solutions of the present invention thus does not limit the scope thereof, although the present invention is described by making reference to the embodiments above, a person having ordinary skill in the art should understand various amendments and changes can be made to the technical solutions of the embodiments as described above, or equivalent substitutes can be used in place of some specific technical features therein without departing from the spirit and scope of the disclosure as defined by the appended claims and/or equivalents.

What I claim is:

1. A method for automatically compensating a common electrode voltage, characterized in comprising:

step 1, calculating for each pixel of pixels in a line a shift amount between a voltage value corresponding to gray scale data of the pixel and a common electrode voltage, and averaging the shift amount calculated for each pixel of the pixels in the line to calculate average shift amount of the common electrode voltage for the pixels in the line;

step 2, digitally encoding said average shift amount and converting it into an analog signal;

step 3, converting said analog signal into a voltage waveform; and step 4, superposing said voltage waveform with the common electrode voltage waveform to generate a new output signal waveform for driving the common electrode.

2. The method for automatically compensating the common electrode voltage of claim 1, characterized in that said step 1 comprises:

step 11, inputting the gray scale data of the pixels in the one line on the displayed image;

step 12, calculating a voltage value, which is corresponding to each pixel gray scale data and is output to a display screen by a source driver, to form an lookup table, and said lookup table comprises positive source driver output voltage values and negative source driver output voltage values corresponding to each pixel gray scale data, respectively; and step 13, obtaining, for each pixel of the pixels in the line, the voltage value corresponding to the gray scale data of the pixel according to said lookup table, calculating, for each pixel of the pixels in the line the shift amount between the voltage value and the common electrode voltage, and averaging the shift amount calculated for each pixel of the pixels in the line to calculate average shift amount of the common electrode voltage for the pixels in the line.

3. The method for automatically compensating the common electrode voltage of claim 2, characterized in that said step 13 comprises:

step 131, making j=1 and ΔV=0, where j is a serial number of a present pixel point in the one line on the image, and ΔV is total shift amount of the common electrode voltage;

step 132, receiving gray scale data of the j-th pixel point and a polarity control signal of the source driver;

step 133, judging driving polarity of the source driver according to said serial number of the j-th pixel point and said polarity control signal of the source driver, and if it is positive polarity driving, then performing step 134, or if it is negative polarity driving, then performing step 135;

step 134, from the lookup table, looking up a positive polarity source driver output voltage value corresponding to the gray scale data of the j-th pixel point, calculating ΔVj=Vcom−PV, wherein Vcom is the common electrode voltage value, PV is the positive polarity source driver output voltage value corresponding to the gray scale data of the j-th pixel point, and ΔVj is shift amount of the common electrode voltage of the j-th pixel point;

step 135, from the lookup table, looking up a negative polarity source driver output voltage value corresponding to the gray scale data of the j-th pixel point, calculating ΔVj=Vcom NV, wherein Vcom is the common electrode voltage value, NV is the negative polarity source driver output voltage value corresponding to the gray scale data of the j-th pixel point, and ΔVj is the shift amount of the common electrode voltage of the j-th pixel point;

step 136, judging whether j is equal to n, if so, performing step 138, otherwise performing step 137, wherein n is total number of pixel points in the one line on the displayed image;

step 137, making j=j+1, performing step 132;

step 138, calculating $$\Delta V = \sum_{j=1}^{n} \Delta V_j,$$

wherein ΔVj is the shift amount of the common electrode voltage of the j-th pixel point, n is the total number of pixel points in the one line on the displayed image, and ΔV is total shift amount of the common electrode voltage; and step 139, calculating ΔVcom=ΔV/n, wherein ΔV is the total shift amount of the common electrode voltage, n is the total number of pixel points in the one line on the displayed image, and ΔVcom is average shift amount of the common electrode voltage.

4. The method for automatically compensating the common electrode voltage of claim 1, characterized in that converting said analog signal into a voltage waveform in said step 3 is that said analog signal is converted into a rectangular voltage waveform, a triangular voltage waveform, a pre-charged triangular voltage waveform or an index voltage waveform, and integration of the waveform is equal to the average shift amount of said common electrode voltage.

5. The method for automatically compensating the common electrode voltage of claim 1, characterized in that said step 4 is that superposing said voltage waveform with the common electrode voltage waveform in order to form said new output signal waveform having waveform integration equal to sum of the common electrode voltage value and the average shift amount of the common electrode voltage.

6. A device for automatically compensating the common electrode voltage and implementing the method for automatically compensating common electrode voltage of claim 1, characterized in comprising:

a data input module for inputting gray scale data of all pixel points in a line on a displayed image;

a looking up module for calculating a voltage value outputted to a display screen by a source driver corresponding to each gray scale data so as to form a lookup table;

a signal module for inputting a source driver polarity control signal and a common electrode voltage waveform;

a data operation module connected with said data input module, said looking up module and said signal module, for obtaining, for each of the pixels in the line, the voltage value corresponding to the gray scale data of the pixel according to said look up table, calculating for each pixel of the pixels in the line the shift amount between the voltage value and the common electrode voltage, and averaging the shift amount calculated for each pixel of the pixels in the line to calculate the average shift amount of the common electrode voltage for the pixels in the line;

a data encoding and converting module connected with the data operation module, and for digitalizing said average shift amount into a digital signal, and converting said digital signal into an analog signal;

a waveform generator connected with said data encoding and converting module, and for converting said analog signal into a voltage waveform; and an operational amplification module connected with said waveform generator and said signal module, and for superposing said voltage waveform with said common electrode voltage waveform to form a new output signal waveform for driving the common electrode.

7. The device for automatically compensating the common electrode voltage of claim 6, characterized in that said data operation module comprises:

a receiving sub module connected with said data input module and said signal module, and for receiving data;

a judging sub module connected with said looking up module and said receiving sub module, and for performing operation judgment and outputting an instruction;

a operating sub module connected with said judging sub module and for obtaining, for each pixel of the pixels in the line, the voltage value corresponding to the gray scale data of the pixel according to said lookup table, calculating, for each pixel of the pixels in the line the shift amount between the voltage value and the common electrode voltage, and averaging the shift amount calculated for each pixel of the pixels in the line to calculate average shift amount of the common electrode voltage for the pixels in the line;

a storage sub module connected with said judging sub module and said operating sub module and for storing data; and an output sub module connected with said operating sub module and said data encoding and converting module, and for outputting the average shift amount of the common electrode.

8. A device for automatically compensating the common electrode voltage and implementing the method for automatically compensating common electrode voltage of claim 2, characterized in comprising:

a data input module for inputting gray scale data of all pixel points in a line on a displayed image;

a looking up module for calculating a voltage value outputted to a display screen by a source driver corresponding to each gray scale data so as to form a lookup table;

a signal module for inputting a source driver polarity control signal and a common electrode voltage waveform;

a data operation module connected with said data input module, said looking up module and said signal module, for obtaining, for each of the pixels in the line, the voltage value corresponding to the gray scale data of the pixel according to said look up table, calculating for each pixel of the pixels in the line the shift amount between the voltage value and the common electrode voltage, and averaging the shift amount calculated for each pixel of the pixels in the line to calculate the average shift amount of the common electrode voltage for the pixels in the line;

a data encoding and converting module connected with the data operation module, and for digitalizing said average shift amount into a digital signal, and converting said digital signal into an analog signal;

a waveform generator connected with said data encoding and converting module, and for converting said analog signal into a voltage waveform; and an operational amplification module connected with said waveform generator and said signal module, and for superposing said voltage waveform with said common electrode voltage waveform to form a new output signal waveform for driving the common electrode.

9. A device for automatically compensating the common electrode voltage and implementing the method for automatically compensating common electrode voltage of claim 3, characterized in comprising:

a data input module for inputting gray scale data of all pixel points in a line on a displayed image;

a looking up module for calculating a voltage value outputted to a display screen by a source driver corresponding to each gray scale data so as to form a lookup table;

a signal module for inputting a source driver polarity control signal and a common electrode voltage waveform;

a data operation module connected with said data input module, said looking up module and said signal module, for obtaining, for each of the pixels in the line, the voltage value corresponding to the gray scale data of the pixel according to said look up table, calculating for each pixel of the pixels in the line the shift amount between the voltage value and the common electrode voltage, and averaging the shift amount calculated for each pixel of the pixels in the line to calculate the average shift amount of the common electrode voltage for the pixels in the line;

a data encoding and converting module connected with the data operation module, and for digitalizing said average shift amount into a digital signal, and converting said digital signal into an analog signal;

a waveform generator connected with said data encoding and converting module, and for converting said analog signal into a voltage waveform; and an operational amplification module connected with said waveform generator and said signal module, and for superposing said voltage waveform with said common electrode voltage waveform to form a new output signal waveform for driving the common electrode.

10. A device for automatically compensating the common electrode voltage and implementing the method for automatically compensating common electrode voltage of claim 4, characterized in comprising:

a data input module for inputting gray scale data of all pixel points in a line on a displayed image;

a looking up module for calculating a voltage value outputted to a display screen by a source driver corresponding to each gray scale data so as to form a lookup table;

a signal module for inputting a source driver polarity control signal and a common electrode voltage waveform;

a data operation module connected with said data input module, said looking up module and said signal module, for obtaining, for each of the pixels in the line, the voltage value corresponding to the gray scale data of the pixel according to said look up table, calculating for each pixel of the pixels in the line the shift amount between the voltage value and the common electrode voltage, and averaging the shift amount calculated for each pixel of the pixels in the line to calculate the average shift amount of the common electrode voltage for the pixels in the line;

a data encoding and converting module connected with the data operation module, and for digitalizing said average shift amount into a digital signal, and converting said digital signal into an analog signal;

a waveform generator connected with said data encoding and converting module, and for converting said analog signal into a voltage waveform; and an operational amplification module connected with said waveform generator and said signal module, and for superposing said voltage waveform with said common electrode voltage waveform to form a new output signal waveform for driving the common electrode.

11. A device for automatically compensating the common electrode voltage and implementing the method for automatically compensating common electrode voltage of claim 5, characterized in comprising:

a data input module for inputting gray scale data of all pixel points in a line on a displayed image;

a looking up module for calculating a voltage value outputted to a display screen by a source driver corresponding to each gray scale data so as to form a lookup table;

a signal module for inputting a source driver polarity control signal and a common electrode voltage waveform;

a data operation module connected with said data input module, said looking up module and said signal module, and for calculating the average shift amount of the common electrode voltage according to the gray scale data of the pixel in the one line on the displayed image;

a data encoding and converting module connected with the data operation module, and for digitalizing said average shift amount into a digital signal, and converting said digital signal into an analog signal;

a waveform generator connected with said data encoding and converting module, and for converting said analog signal into a voltage waveform; and an operational amplification module connected with said waveform generator and said signal module, and for superposing said voltage waveform with said common electrode voltage waveform to form a new output signal waveform for driving the common electrode.

12. The device for automatically compensating the common electrode voltage of claim 8, characterized in that said data operation module comprises:

a receiving sub module connected with said data input module and said signal module, and for receiving data;

a judging sub module connected with said looking up module and said receiving sub module, and for performing operation judgment and outputting an instruction;

an operating sub module connected with said judging sub module and for obtaining, for each pixel of the pixels in the line, the voltage value corresponding to the gray scale data of the pixel according to said lookup table, calculating, for each pixel of the pixels in the line the shift amount between the voltage value and the common electrode voltage, and averaging the shift amount calculated for each pixel of the pixels in the line to calculate average shift amount of the common electrode voltage for the pixels in the line;

a storage sub module connected with said judging sub module and said operating sub module and for storing data; and an output sub module connected with said operating sub module and said data encoding and converting module, and for outputting the average shift amount of the common electrode.

13. The device for automatically compensating the common electrode voltage of claim 9, characterized in that said data operation module comprises:

a receiving sub module connected with said data input module and said signal module, and for receiving data;

a judging sub module connected with said looking up module and said receiving sub module, and for performing operation judgment and outputting an instruction;

a operating sub module connected with said judging sub module and for obtaining, for each pixel of the pixels in the line, the voltage value corresponding to the gray scale data of the pixel according to said lookup table, calculating, for each pixel of the pixels in the line the shift amount between the voltage value and the common electrode voltage, and averaging the shift amount calculated for each pixel of the pixels in the line to calculate average shift amount of the common electrode voltage for the pixels in the line;

a storage sub module connected with said judging sub module and said operating sub module and for storing data; and an output sub module connected with said operating sub module and said data encoding and converting module, and for outputting the average shift amount of the common electrode.

14. The device for automatically compensating the common electrode voltage of claim 10, characterized in that said data operation module comprises:

a receiving sub module connected with said data input module and said signal module, and for receiving data;

a judging sub module connected with said looking up module and said receiving sub module, and for performing operation judgment and outputting an instruction;

an operating sub module connected with said judging sub module and for obtaining, for each pixel of the pixels in the line, the voltage value corresponding to the gray scale data of the pixel according to said lookup table, calculating, for each pixel of the pixels in the line the shift amount between the voltage value and the common electrode voltage, and averaging the shift amount calculated for each pixel of the pixels in the line to calculate average shift amount of the common electrode voltage for the pixels in the line;

a storage sub module connected with said judging sub module and said operating sub module and for storing data; and an output sub module connected with said operating sub module and said data encoding and converting module, and for outputting the average shift amount of the common electrode.

15. The device for automatically compensating the common electrode voltage of claim 11, characterized in that said data operation module comprises:

a receiving sub module connected with said data input module and said signal module, and for receiving data;

a judging sub module connected with said looking up module and said receiving sub module, and for performing operation judgment and outputting an instruction;

an operating sub module connected with said judging sub module and for obtaining, for each pixel of the pixels in the line, the voltage value corresponding to the gray scale data of the pixel according to said lookup table, calculating, for each pixel of the pixels in the line the amount between the voltage value and the common electrode voltage, and averaging the shift amount calculated for each pixel of the pixels in the line to calculate average shift amount of the common electrode voltage for the pixels in the line;

a storage sub module connected with said judging sub module and said operating sub module and for storing data; and an output sub module connected with said operating sub module and said data encoding and converting module, and for outputting the average shift amount of the common electrode.

16. The method for automatically compensating the common electrode voltage of claim 1 wherein said gray scale data of pixels in a line on a displayed image of a liquid crystal display.

* * * * *